US007937880B1

(12) United States Patent
Fidlow

(10) Patent No.: US 7,937,880 B1
(45) Date of Patent: May 10, 2011

(54) CAMERA INTEGRATED FIREARM SYSTEM AND METHOD

(76) Inventor: Hal Fidlow, Cranford, NJ (US)

( * ) Notice: Subject to any disclaimer, the term of this patent is extended or adjusted under 35 U.S.C. 154(b) by 226 days.

(21) Appl. No.: 12/384,790

(22) Filed: Apr. 7, 2009

Related U.S. Application Data

(63) Continuation-in-part of application No. 11/602,761, filed on Nov. 21, 2006, now abandoned.

(60) Provisional application No. 60/844,934, filed on Sep. 15, 2006.

(51) Int. Cl.
*F41G 1/00* (2006.01)
*F41G 11/00* (2006.01)
*F41C 27/00* (2006.01)

(52) U.S. Cl. ..... 42/146; 42/90; 396/426

(58) Field of Classification Search ..... 42/90, 111, 42/146; 89/41.05; 224/908; 206/316.2; 396/426

See application file for complete search history.

(56) References Cited

U.S. PATENT DOCUMENTS

| | | | | |
|---|---|---|---|---|
| 1,955,300 | A * | 4/1934 | Kurnick | 396/426 |
| 6,000,163 | A * | 12/1999 | Gordon | 42/119 |
| 6,892,488 | B1 * | 5/2005 | Serravalle | 42/113 |
| 2005/0174434 | A1 * | 8/2005 | Chang et al. | 348/211.1 |
| 2005/0179799 | A1 * | 8/2005 | Umanskiy et al. | 348/333.01 |
| 2006/0082730 | A1 * | 4/2006 | Franks | 352/95 |
| 2006/0086032 | A1 * | 4/2006 | Valencic et al. | 42/70.01 |

* cited by examiner

*Primary Examiner* — Bret Hayes
(74) *Attorney, Agent, or Firm* — Stuart M. Goldstein

(57) ABSTRACT

A camera integrated firearm system replaces the original recoil spring and guide assembly of a firearm with a casing which includes a camera, a camera actuating module which turns the camera on when the orientation of the handgun barrel is changed, a gunshot impact sensing and signal transmitting module, an image memory module, and output data ports. The casing is also equipped with a unique power-data port integrated into the lens unit of the camera. When the weapon is drawn, the camera is turned on to record events, including the discharge of the weapon. The camera, utilizing ambient light plus the light generated by muzzle flash, i.e. the jet of fire exiting the barrel at the instant the bullet exits the weapon, takes and saves, in memory, a closely spaced sequential stream of digital photographs or, alternatively, video recordings. Using the data outputs, the images can then be downloaded for viewing.

12 Claims, 10 Drawing Sheets

A - ACTUATING TRIGGER
E - EXPLOSION IN CHAMBER
B - BULLET FIRED
S - EXPLOSION SENSOR / SWITCH
T - TARGET
C - CAMERA
I - PICTURE
M - MEMORY

CAMERA INTEGRATED FIREARM SYSTEM AND METHOD

RELATED APPLICATION

The herein application is a continuation-in-part of application Ser. No. 11/602,761 filed on Nov. 21, 2006, now abandoned which claims the benefit of provisional application Ser. No. 60/844,934, filed on Sep. 5, 2006.

BACKGROUND OF THE INVENTION

The use of firearms by local, state, and federal law enforcement personnel, as well as the military and private security sectors, presents a variety of situations in which the very circumstances surrounding this usage becomes an issue. For instance, oftentimes there are questions as to whether the discharge of a weapon was necessary, what events dictated the firing of a weapon, or who was actually present on the scene and what those individuals may have been doing at the time a weapon was fired. Recounts and recreations of circumstances surrounding the use of firearms is critical to subsequent investigations. However, witness observations, after the fact, are often conflicting and unreliable. Inquiries would be well served if images of the actual incidents which are the subjects of investigation could be viewed by the finder of fact. As a result, the contemporaneous memorialization or recording of the events would be of great value.

The prior art discloses attempts to incorporate information gathering systems into firearms; but such attempts are complex and usually require major modification of the entire weapon. See, for example, U.S. Pat. Pub. No. 2006/0086032. Different types of recoil guide rods have also been developed. However, all these assemblies relate to ancillary weapon functions, unrelated to the instantaneous recording and reporting of events. See, for example, U.S. Pat. Nos. 5,419,072 and 6,892,488.

There have been and is currently no separate, self-contained recoil spring camera assembly which successfully integrates known components into a single compact device designed to efficiently and effectively operate within the guide rod cavity of a firearm, to instantaneously record and report on events, including the weapon's discharge. There are no prior unitary systems which, quite literally, can be dropped into the barrel of a recoil rod cavity of a firearm to replace the standard recoil spring guide for these purposes.

SUMMARY OF THE INVENTION

It is thus the object of the present invention to provide a camera integrated firearm system which addresses these law enforcement and investigatory issues.

It is an object of the present invention to provide a camera integrated firearm system and method which generates and stores, in memory, a series of high speed photographs or videoclips of the person, object or scene at which a firearm is pointed, at the very instant the weapon is fired and the bullet hits its target.

It is another object of the present invention to provide a camera integrated firearm system and method which employs a miniature camera mounted in the recoil spring guide assembly of a firearm to record images, as soon as a weapon is drawn and upon firing of the weapon.

It is still another object of the present invention to provide a camera integrated firearm system and method which, immediately upon a discharge event, transmits notification and the location of the event.

It is a further object of the present invention to provide a camera integrated firearm system and method which does not alter the outward configuration or operation of the firearm in any manner.

It is another object of the present invention to provide a camera integrated firearm system and method which maintains the weapon's accuracy, safety, and reliability.

It is still another object of the present invention to provide a camera integrated firearm system and method which allows the use of existing technology to modify existing handguns and other firearms by replacing the original recoil spring guide assembly of the weapon with the system of the present invention.

These and other objects are accomplished by the present invention, a camera integrated firearm system which mounts within the barrel of a handgun or other weapon. More specifically, the original recoil spring and guide assembly of the firearm is replaced with a casing which includes a camera, a camera actuating module which turns the camera on when the orientation of the handgun barrel is changed, a gunshot impact sensing and signal transmitting module, an image memory module, and output data ports. The casing is also equipped with a unique power-data port integrated into the lens unit of the camera. When the weapon is drawn, the camera is turned on to record events, including the discharge of the weapon. The camera, utilizing ambient light plus the light generated by muzzle flash, i.e. the jet of fire exiting the barrel at the instant the bullet exits the weapon, takes and saves, in memory, a closely spaced sequential stream of digital photographs or, alternatively, video recordings. Using the data outputs, the images can then be downloaded for viewing.

Novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
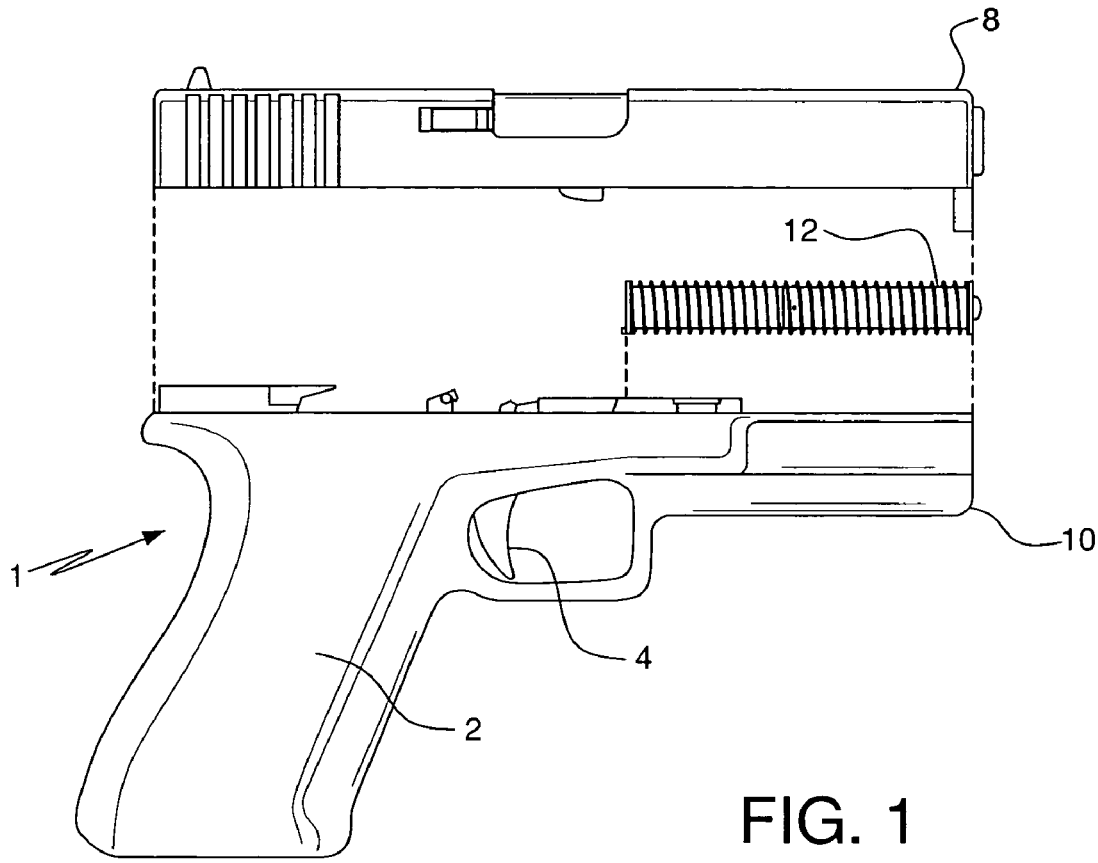
FIG. 1 is an exploded view of a handgun incorporating the present invention.
Figure 2:
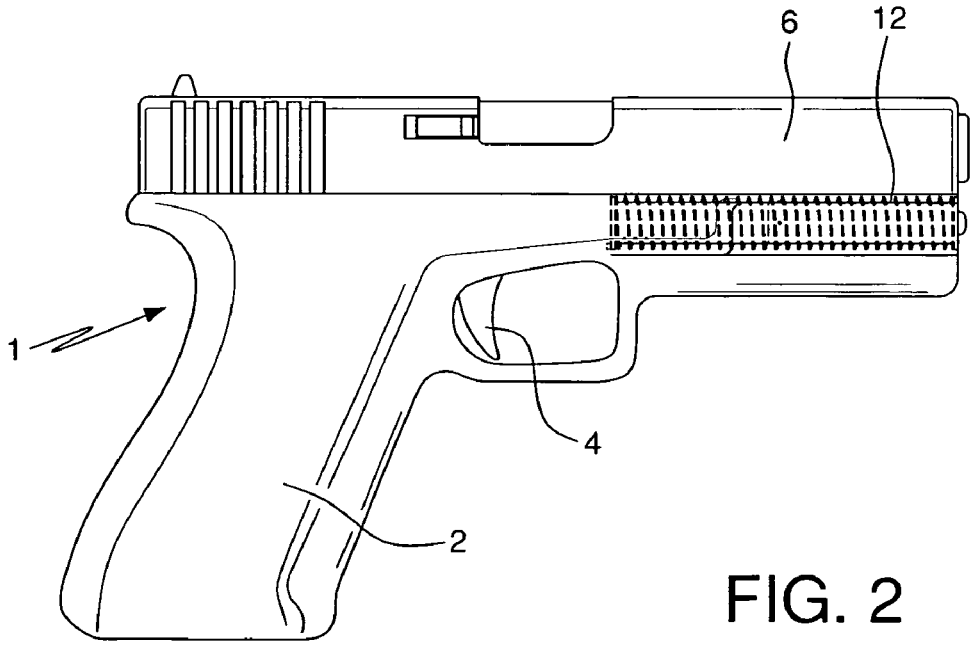
FIG. 2 is a side view of a handgun showing the present invention installed.
Figure 3:
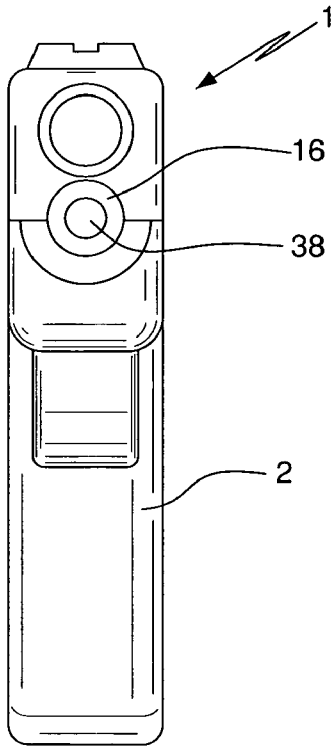
FIG. 3 is a front view of a handgun with the present invention installed.
Figure 4:
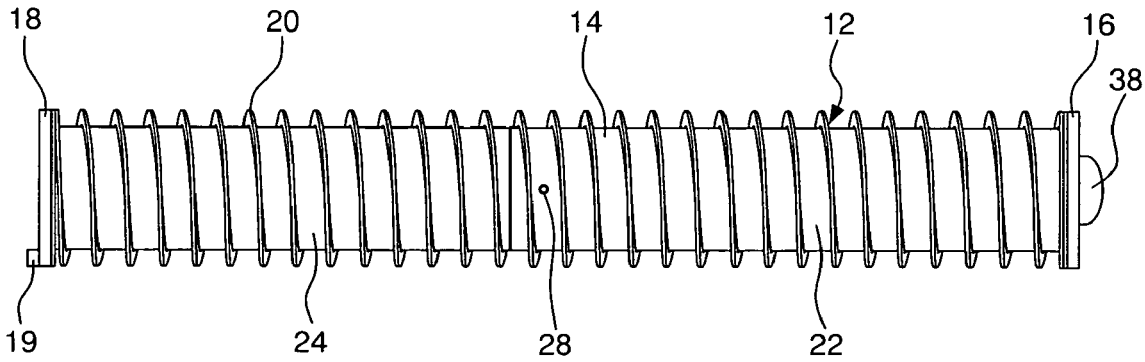
FIG. 4 is an elevation view of the recoil spring guide camera assembly of the present invention.
Figure 5:
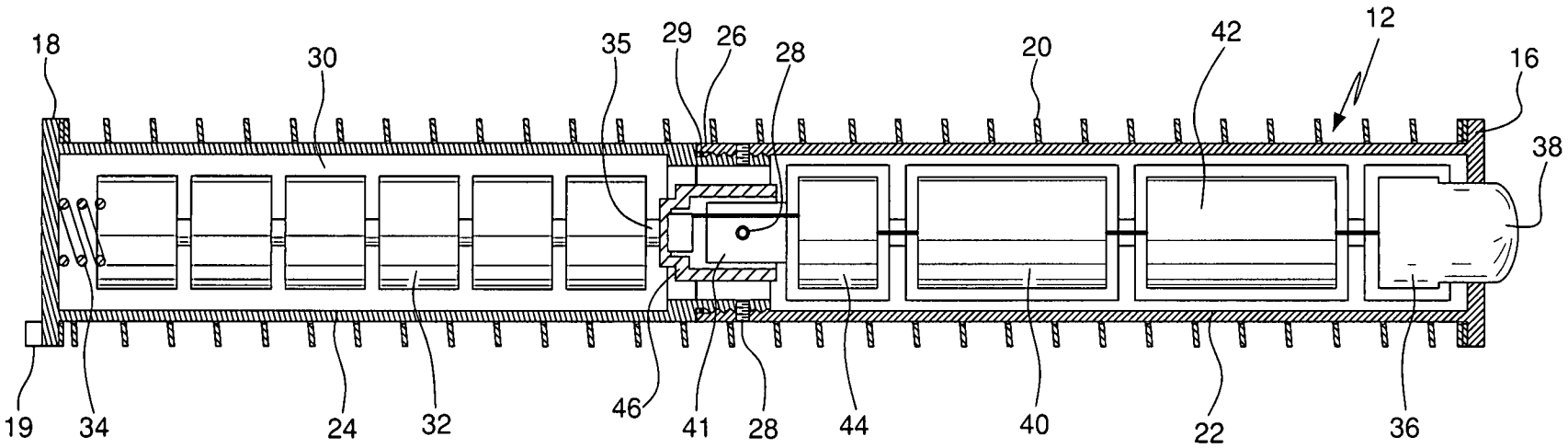
FIG. 5 is a cross-sectional view of the recoil spring guide camera assembly of the present invention.
Figure 6:
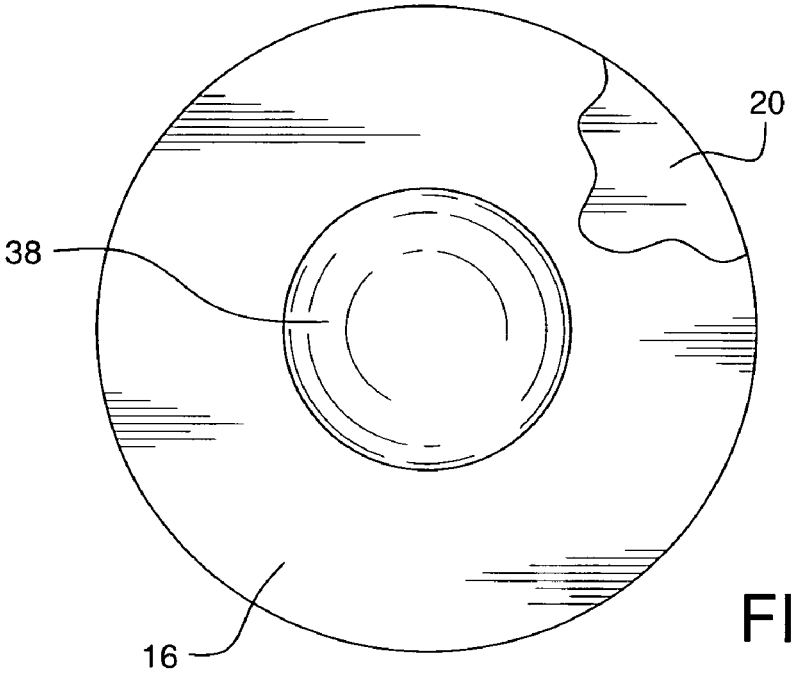
FIG. 6 is a front view of the recoil spring guide camera assembly of the present invention.
Figure 7:
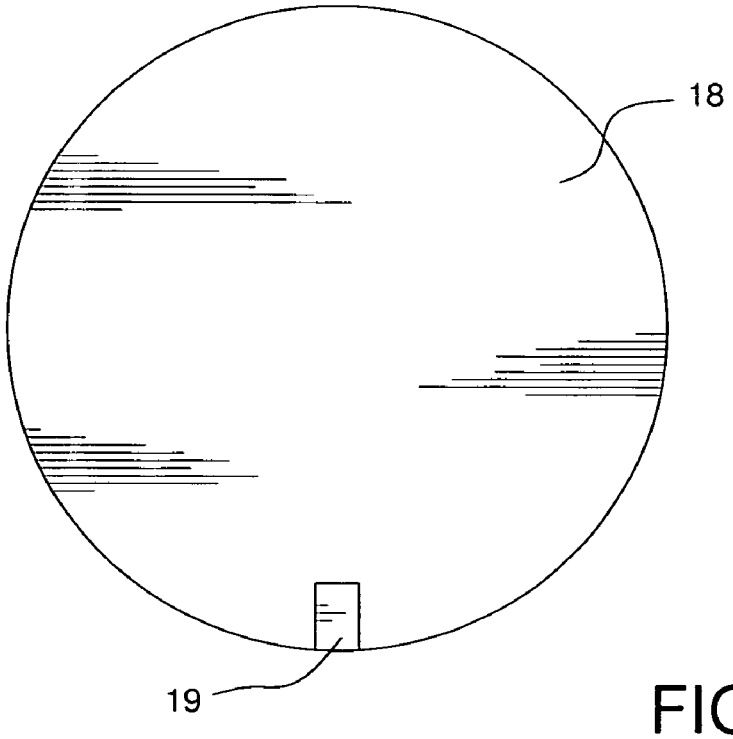
FIG. 7 is a rear view of the recoil spring guide camera assembly of the present invention.
Figure 8:
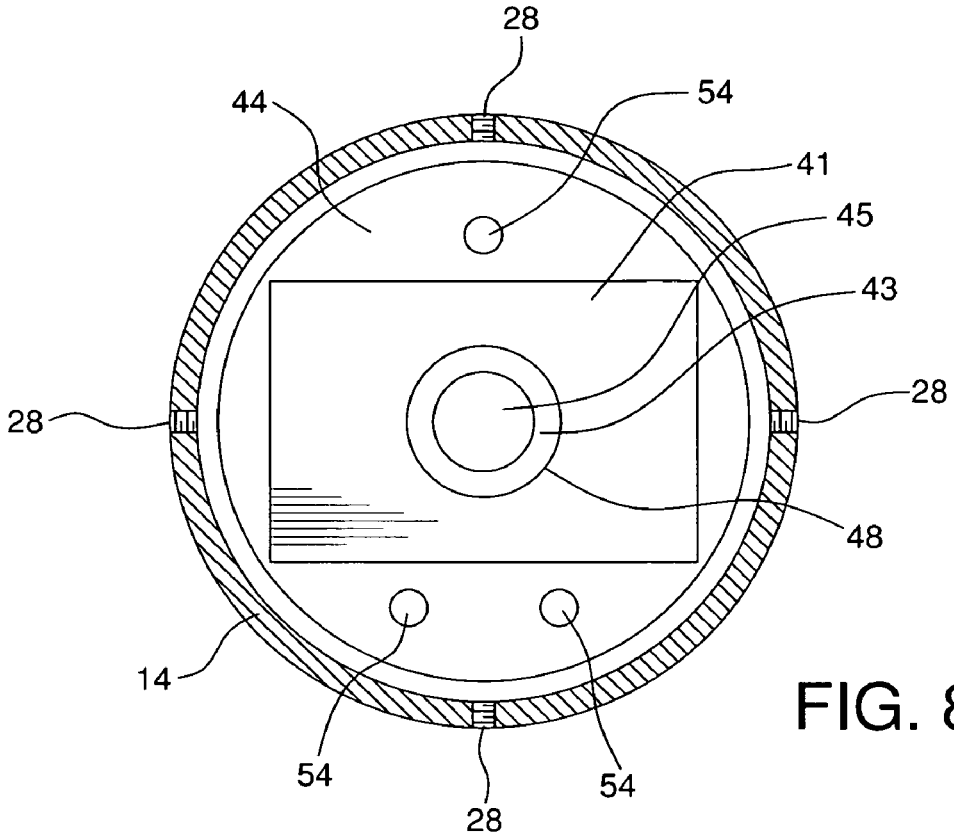
FIG. 8 is an end view of the computer interface/battery connection, mounted within the casing of the present invention, looking forward toward the front of the recoil spring guide camera assembly of the present invention.
Figure 9:
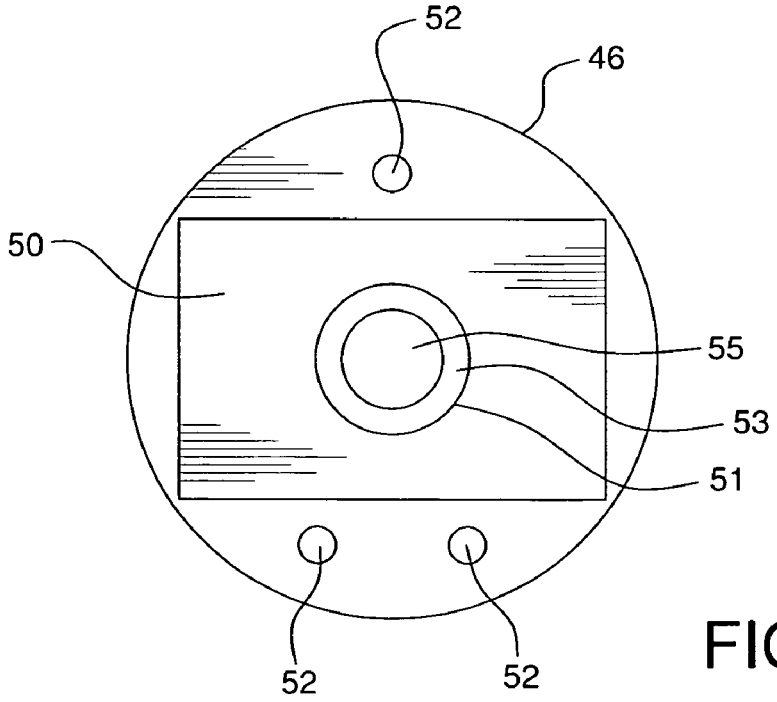
FIG. 9 is a front view of the power adapter employed in the present invention.

Handgun 1 comprises gun body 2 having trigger 4 and gun barrel or muzzle 6, with upper half 8 and lower half 10. Recoil spring guide camera assembly 12 is configured to replace the standard recoil spring guide in lower half 10 of muzzle 6 of the gun. Assembly 12 comprises outer casing or housing 14. Casing 14 is optimally made of corrosion resistant steel or similar metal. Recoil spring 20 circumscribes housing 14. Recoil spring retention walls 16 and 18 of assembly 12 are located at the ends of casing 14. Raised notch 19 is provided on the back of rear wall 18. The notch indexes the slot in the receiver (not shown) in lower portion 10 of gun 1, in order to maintain orientation of assembly 12.

Casing 14 is comprised of front section 22 and rear section 24. Sections 22 and 24 are threadably connected at 26 and secured with barrel locking screws 28. An O-ring spacer 29, provides a secure seal between sections 22 and 24.

Rear section 24 comprises open space 30 in which battery 32, compelled against battery contact spring 34, is positioned.

Located within and forwardmost of front section 22 of casing 14 is high speed camera 36 with lens 38 extending through retention wall 16. Camera 36 can be an infrared camera which operates effectively in low light conditions. Also positioned within section 22 are gunshot impact and switching module 40, camera control and memory module 42, and computer interface/battery powered connector 44. Power/data adapter 46, positioned between battery 32 and connector 44, provides connectivity of electrical power from the battery to the components located within front section 22.

The electronic interconnections between components, i.e. impact and switching module 40, camera control and memory module 42, and high speed camera 36, are well known in the electronic arts, as are the individual components themselves. The present invention is not directed to the individual, commercially available components which make up the system and method of the invention or to the manner of interconnection of these components.

Computer interface/battery powered connector 44 comprises power/data outport port 48 with center contact 45 and side contact 43, providing ports for external connection with electronic components. Rectangular plug-in connector 41 of connector 44 is configured to extend into power/data adaptor 46. Alignment holes 54 are located within front wall of plug-in connection 41.

Adapter 46 is configured with plug-in opening 50 configured to receive rectangular plug-in connection 41 from connector 44. Power data output port 51 with center contact 55 and side contact 53 are provided as ports for external connection with electronic components. Alignment pins 52 extending from adapter 46 are configured to be positioned within alignment holes 54 in connector 44.

Power/data adapter 46 is configured to rotate freely within rear section 24 of casing 14 and is held in place by front battery contact 35, which in turn is pressed against the adapter by compressive tension from battery spring 34.

Figure 10:
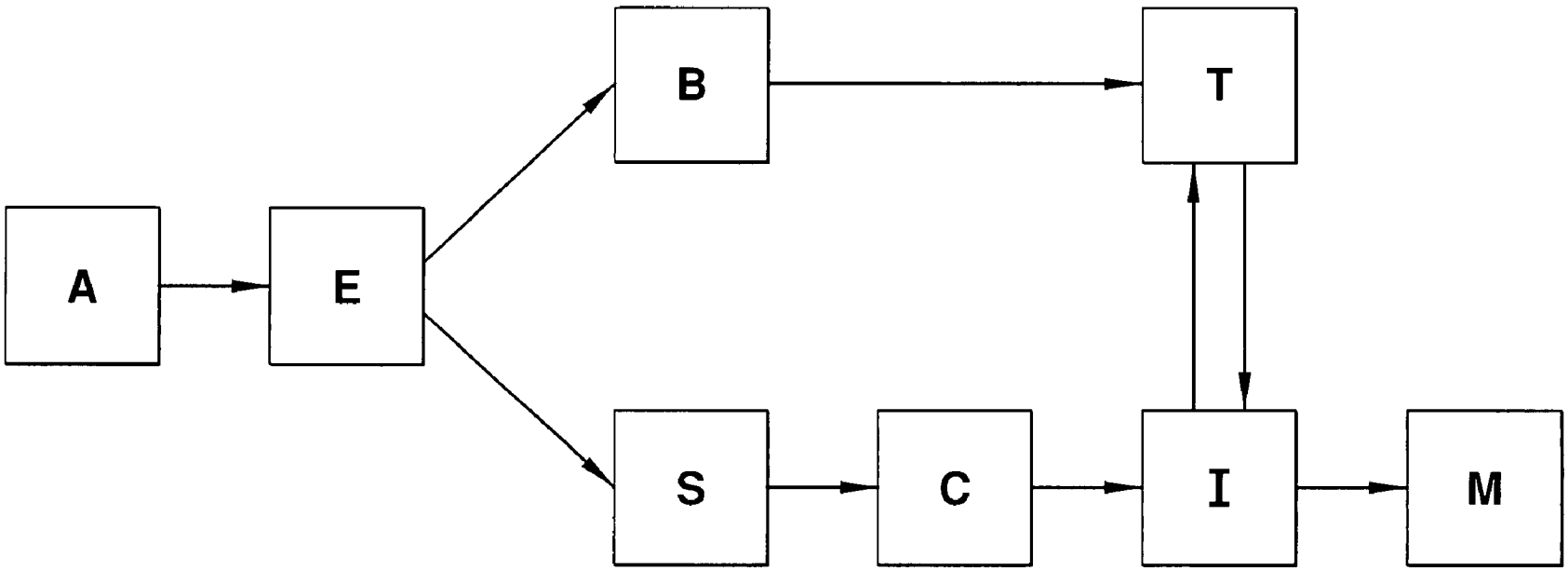
FIG. 10 is a schematic representation of the operation of the present invention.
Figure 11:
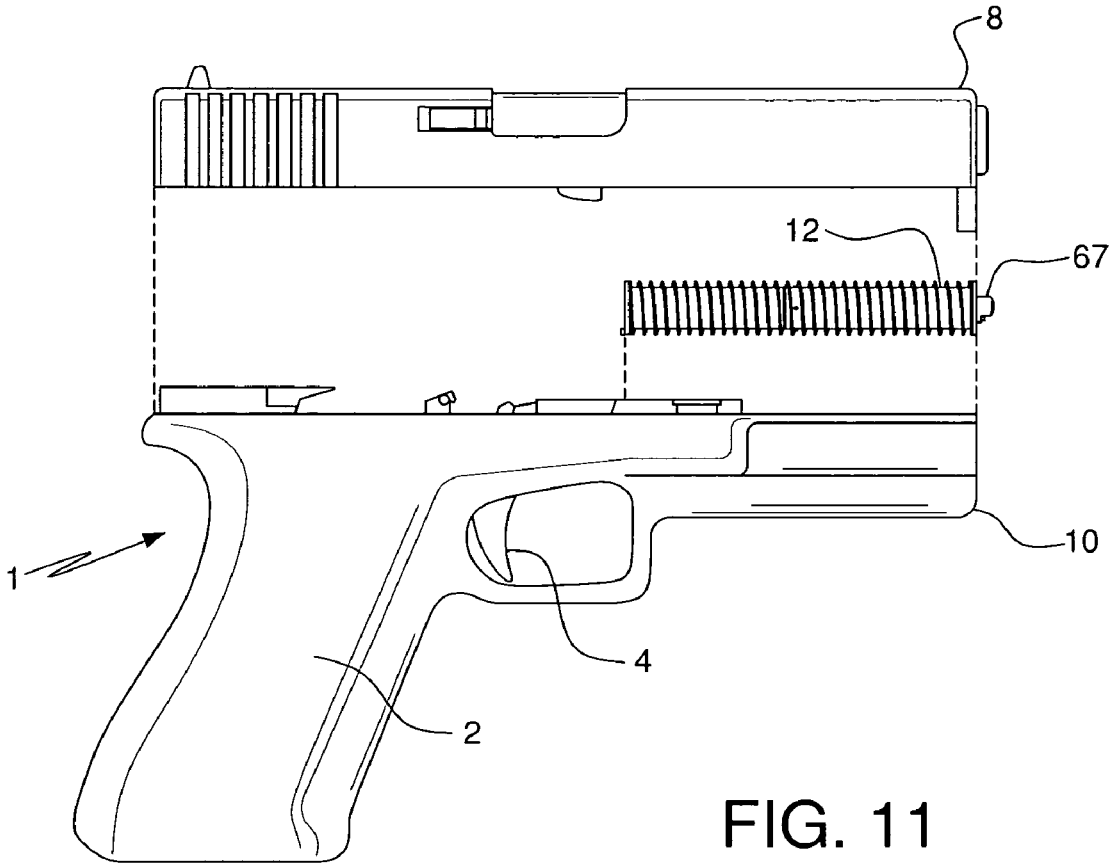
FIG. 11 is an exploded view of a handgun showing a second embodiment of the present invention.
Figure 12:
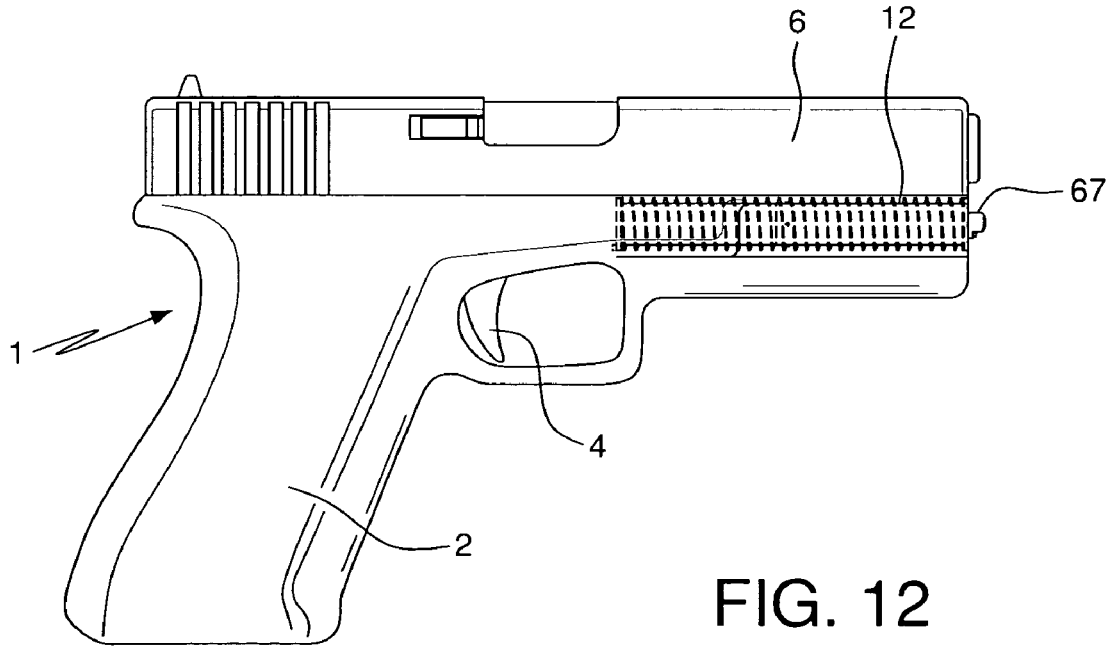
FIG. 12 is a side view of a handgun showing the second embodiment of the present invention.
Figure 13:
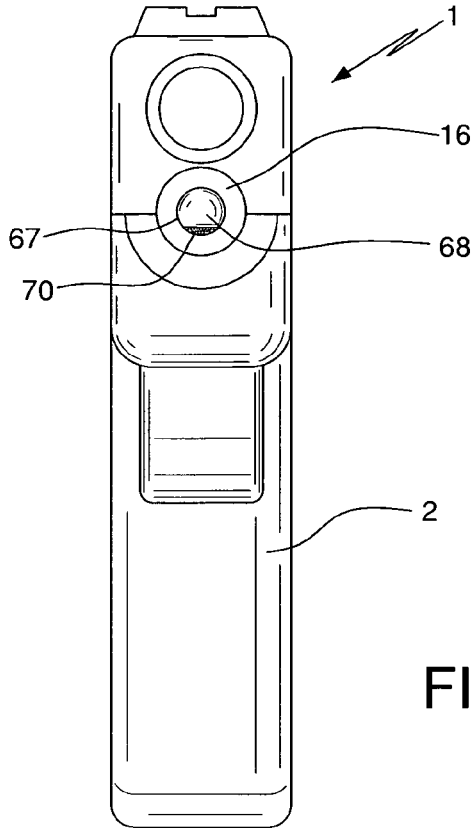
FIG. 13 is a front view of a handgun showing the second embodiment of the present invention.
Figure 14:
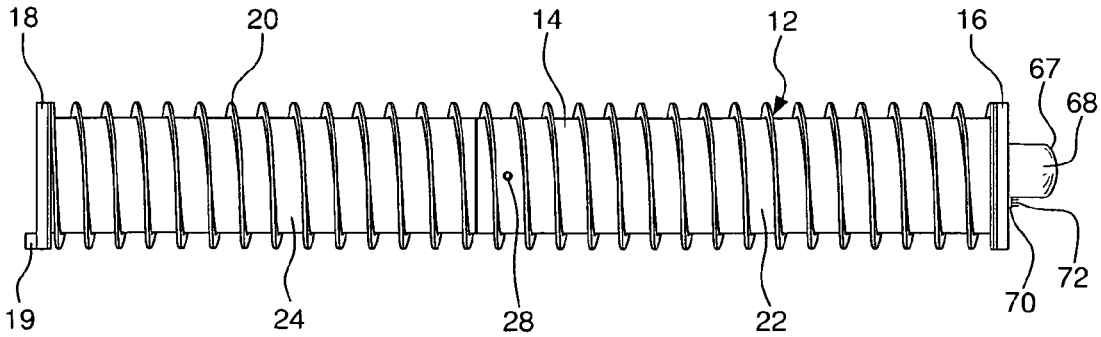
FIG. 14 is an elevation view of the second embodiment of the recoil spring guide camera assembly of the present invention.
Figure 15:
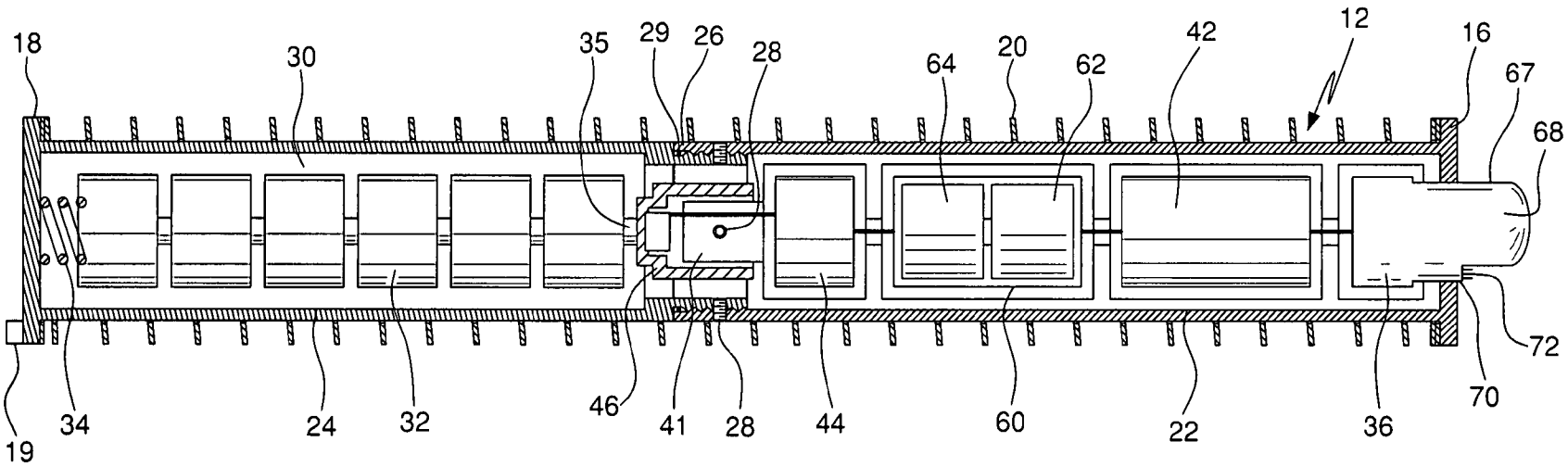
FIG. 15 is a cross-sectional view of the second embodiment of the recoil spring guide camera assembly of the present invention.
Figure 16:
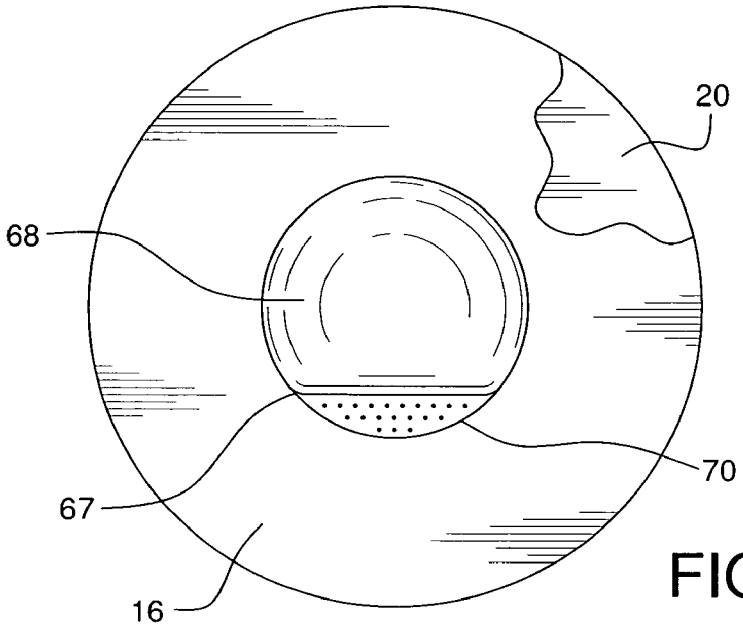
FIG. 16 is a front view showing the lens and front retention wall of the second embodiment of the present invention.
Figure 17:
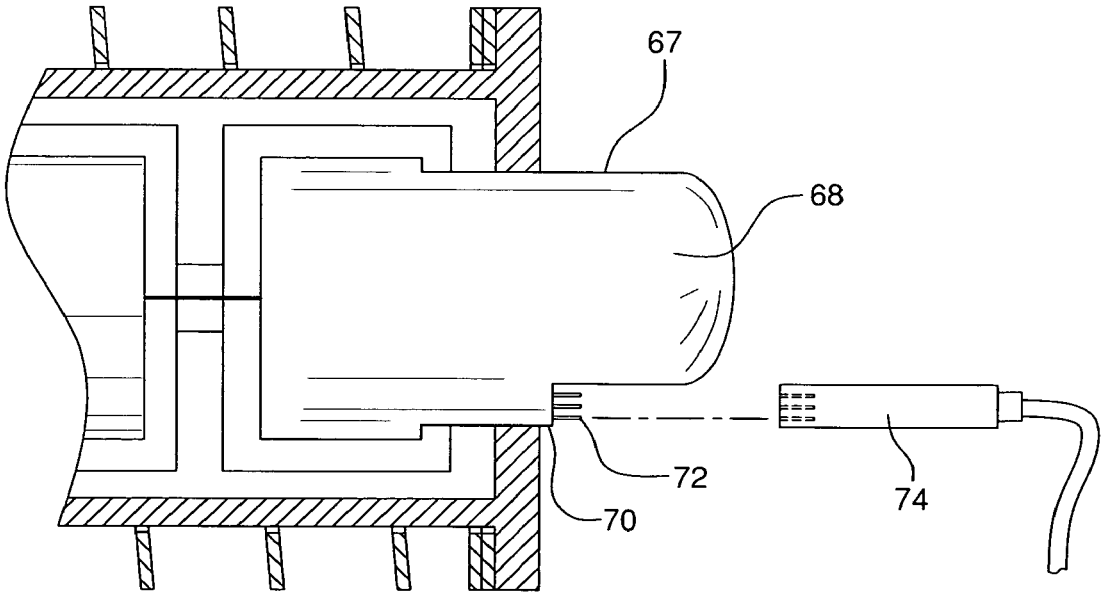
FIG. 17 is a partial cross-sectional view of the front end of the second embodiment of the present invention.

The sequence of operation of the invention is readily appreciated by reference to FIG. 10. Pulling or actuating trigger 4, A causes explosion E within gun 1, causing discharge and firing of bullet B. Explosion E is sensed by explosion/impact sensor switch S which actuates camera C. Visual images I are then contemporaneously taken of target T and these images are stored in camera memory M.

Images I can be downloaded via power/data output port 48 at the end of connector 44, to a computer, PDA, micro SD cards, interne connection, or other receiving device. Output port 48 can be configured for a USB connection or similar plug-in jack for retrieving images I from memory M/42.

Should the firing of handgun 1 be deemed an event requiring a permanent video recording, assembly 12 is simply removed from the gun by field stripping, the standard gun maintenance procedure, and unassembled and reassembled as follows:

1. Barrel locking screws 28 are removed.
2. Rear section 24 is unscrewed from front section 22.
3. Recoil spring 20 is removed by sliding it off casing 14.
4. Battery 32 and power/data adapter 46 are removed.
5. A video out cable, supplied as part of the invention support package (not shown) is plugged into output port 48.
6. Contents from camera memory 42 are downloaded.
7. Fresh battery 32 is installed, if warranted.
8. Components are reassembled in reverse order.
9. Assembly 12 is reinstalled into gun by field stripping.

Camera 36 can be a high digital camera capable of taking a series of high speed photographs, in rapid succession, preserving them in memory, or it can be a video camera which takes a video clip of events at time of firearm discharge.

An alternate embodiment of the invention is shown in FIGS. 11-17. In this configuration, gunshot impact and switching module 40 is replaced by impact sensing and message module 60 which comprises submodule components 62 and 64. Submodule component 62 is a "camera on" tilt switch which activates camera 36 upon a change in orientation of gun barrel 6. Thus, anytime the orientation of handgun 1 changes, e.g. when the weapon is drawn from a "down/holstered" position to a firing position, submodule component 62 turns on camera 36, which begins recording, either still photographs or video events.

Submodule 64, an impact and message module, is a combination impact sensor/GPS receiver/cell or internetradio transmitter. Immediately upon sensing impact, i.e. discharge of handgun 1, submodule 64 transmits notification of the weapon having been fired, the weapon ID number, and real time GPS location to a cell tower, internet station, or other signal receiving facility.

Another significant feature of the embodiment shown in FIGS. 11-17 is the incorporation of an external power/data port into the lens component. Lens unit 67 comprises lens 68 which extends slightly further out from front retention wall 16. Extending below lens 68 is a recessed, polarity protected, external port 70 having plug-in connectors 72 configured to engage and mate with separate plug-in component 74. Lens 68 protrudes out only slightly to allow proper orientation of external port 70 without interfering with or degrading the camera's range of vision.

The use of external port 70, via component 74, serves to charge batteries 32, which can be rechargeable lithium batteries. Such batteries can be readily and easily charged by simple, plug-in connection, similar to charging a cell phone. In this manner, batteries will not need to be removed for years.

The use of external port 70, via component 74, also allows software to be uploaded, photographs and video to be downloaded, and generally provides electronic communication to or from the components within casing 14. Thus, the components within casing 14 can be accessed without having to remove the casing from handgun 1 or the need to open the casing. The presence of lens mounted, external port 70 relegates power/data port 48 within casing 14 to a secondary port, for use in the event that port 70 is damaged or fouled by gunpowder, soot or other debris.

The firearm using recoil spring guide camera assembly 12 is thus fully self-contained. The assembly is installed without any modifications to the firearm receiving the assembly. Installation is achieved by field stripping the weapon and replacing its recoil guide and recoil spring with assembly 12. Experienced weapon's handlers can perform the installation in less than two minutes.

The invention, itself, is designed to be incorporated into a firearm in such a manner that a handgun, for instance, will fit into its existing holster, will have the same weight and balance, will have no additional controls or on/off switches, and will operate with no degradation in reliability, safety, or accuracy. The invention operates without any indication to the operator or anyone else that each time the gun is fired, a series of photographs will be automatically taken and stored.

The operation of the camera is completely automatic, silent, and does not require focus or other adjustments by the operator. The invention is oriented in such a manner as to view the object at which the gun is aimed. By designing the invention to replace the recoil spring and recoil spring guide and having the impact of the exploding gun powder within the bullet cartridge at the instant the gun is fired activate the camera's operation, images are taken at the precise time of discharge. The invention has also been designed to maintain upright camera orientation within a 15 degree arc, thereby making video generated by the camera easy to view. It also can be readily converted to television format for media newscasts.

Assembly 12 disclosed herein is designed to operate inside a Glock Model 21, a widely issued handgun carried by federal, state, and municipal law enforcement. The invention installs into this model of handgun without any modifications to the gun. However, the present invention is not restricted to this weapon, but can be adapted for use in most firearms. Each specific firearm will require a version of the invention engineered for that specific model. The basic design, spirit, and function however are based upon the drawings provided and the intent of the drawings is to cover all firearms which employ a recoil spring guide and recoil spring, i.e. nearly every modern semi-automatic and fully automatic weapon in production today.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A self-contained firearm recoil spring camera assembly for a firearm having a barrel, a recoil guide rod cavity, and a trigger, said assembly comprising:

an outer casing to be located within the recoil guide rod cavity of a firearm, said casing having a front section, a rear section, a front retention wall located forwardmost of the front section, and a rear retention wall located aftermost of the rear section, said rear retention wall having a tab projection to assist in assembly orientation;

means to interconnect the front and rear sections, wherein said means to interconnect is located at the complementary ends of the sections and allows disconnection of the sections;

a camera with a lens unit located within the front section of the casing, the camera lens unit extending out of the casing and through the front retention wall;

camera actuating means for recording visual images upon a change in orientation of a barrel of a firearm, wherein said camera actuation means is located within the front section;

means for sensing the discharge of a firearm and, upon sensing discharge, transmitting signals providing notification of discharge and location of discharge, wherein said sensing means is located within the front section;

means for storing the visual images, wherein said means for storing is located within the front section;

means to power the camera located within the rear section of the casing;

means for retrieving said visual images, wherein said means for retrieving is located within the casing;

means for electronic communication with the means for storing and the means for retrieving, and for recharging the power means, wherein said means for electronic communication is located outside the casing, integrated into the camera lens;

means to transfer power from the power means to the means for sensing and transmitting, the camera actuating means, the means for storing the visual images, and the means for retrieving the visual images, wherein said means to transfer power is located within the casing; and a recoil spring externally circumscribing the casing and extending from the front retention wall to the rear retention wall.

2. The assembly as in claim 1 wherein the means to power comprises a battery.

3. The assembly as in claim 1 wherein the means to transfer power comprises a power/data adapter rotatably mounted within the casing.

4. The assembly as in claim 1 wherein the means for retrieving visual images comprises means for outputting data.

5. The assembly as in claim 1 wherein the means for electronic communication comprises a power data port.

6. The assembly as in claim 5 wherein the power data port is configured to mate with a plug-in connector.

7. A firearm with a barrel, a recoil guide rod cavity, and trigger, said firearm comprising:

a self-contained recoil spring camera assembly located within the recoil guide rod cavity, said assembly comprising:

an outer casing having a front section, a rear section, a front retention wall located forwardmost of the front section, and a rear retention wall located aftermost of the rear section, said rear retention wall having a tab projection to assist in assembly orientation;

means to interconnect the front and rear sections, wherein said means to interconnect is located at the complementary ends of the sections and allows disconnection of the sections;

a camera with a lens unit located within the front section of the casing, the camera lens unit extending out of the casing and through the front retention wall;

camera actuating means for recording visual images upon a change in orientation of the barrel of the firearm, wherein said camera actuating means is located within the front section;

a gunshot impact and message module located within the front section of the casing, said module comprising means for sensing gunshots and transmitting signals providing notification of discharge and location of discharge;

memory means for storing visual images taken by the camera, wherein said memory means is located within the front section;

means for retrieving said visual images, wherein said means for retrieving is located within the casing;

means to power the camera located within the rear section of the casing;

means for electronic communication with the means for storing and the means for retrieving, and for recharging the power means, wherein said means for electronic communication is located outside the casing, integrated into the camera lens;

means to transfer power from the power means to the sensing and message module, the camera actuating means, the means for storing the visual images, and the means for retrieving the visual image, wherein said means to transfer power is located within the casing; and a recoil spring externally circumscribing the casing and extending from the front retention wall to the rear retention wall.

8. The firearm as in claim 7 wherein the means to power comprises a battery.

9. The firearm as in claim 7 wherein the means to transfer power comprises a power/data adapter, rotatably mounted within the casing.

10. The firearm as in claim 7 wherein the means for retrieving visual images comprises means for outputting data.

11. The firearm as in claim 7 wherein the means for electronic communication comprises a power data port.

12. The firearm as in claim 11 wherein the power data port is configured to mate with a plug-in connector.

* * * * *